US010243250B2

(12) United States Patent
U-Yen et al.

(10) Patent No.: US 10,243,250 B2
(45) Date of Patent: Mar. 26, 2019

(54) TWO-WAY MICROWAVE POWER DIVIDER

(71) Applicant: The United States of America as represented by the Administrator of the National Aeronautics and Space Administration, Washington, DC (US)

(72) Inventors: Kongpop U-Yen, Alexandria, VA (US); Nathan Kovarik, Rapid City, SD (US)

(73) Assignee: The United States of America, as represented by the Administrator of the National Aeronautics and Space Administration, Washington, DC (US)

( * ) Notice: Subject to any disclaimer, the term of this patent is extended or adjusted under 35 U.S.C. 154(b) by 19 days.

(21) Appl. No.: 15/432,569

(22) Filed: Feb. 14, 2017

(65) Prior Publication Data

US 2018/0233797 A1 Aug. 16, 2018

(51) Int. Cl.
*H01P 5/18* (2006.01)

(52) U.S. Cl.
CPC ..... *H01P 5/184* (2013.01)

(58) Field of Classification Search
CPC ..... H01P 5/184; H03H 7/40
USPC ..... 333/125–129
See application file for complete search history.

(56) References Cited

U.S. PATENT DOCUMENTS 4,835,496 A * 5/1989 Schellenberg ..... H01P 5/12 330/286
5,179,366 A * 1/1993 Wagner ..... H01C 1/084 338/308

OTHER PUBLICATIONS

Okan Unlu, "Ultra Wideband Tapered Power Combiner/Divider" a thesis submitted to the department of electrical and electronics engineering and the graduate school of engineering and science of Bilkent University in partial fulfillment of the requirements for the degree of master of science, Oct. 2014, pp. 1-63.

Faroq Razzaz et al., "UWB Wilkinson Power Divider Using Tapered Transmission Lines", Department of Electricai Engineering, King Saud University P. O. Box 800, Riyadh 11421, Kingdom of Saudi Arabia, Aug. 19-23, 2012; pp. 882-884, PIERS Proceedings, Moscow, Russia.

B. Mencia-Oliva et al., "New Technique for the Design of Ultra-Broadband Power Dividers based on Tapered Lines", Departamento de Se"nales, Sistemas y Radiocomunicaciones. Universidad Polit'ecnica de Madrid, 2009, pp. 493-496, IEEE, Madrid, Spain.

C.-T.Chiang et al. "Ultra Wideband Power Divider Using Tapered Line", Progress in Electromagnetics Research, Jun. 16, 2010, pp. 61-73, vol. 106, Malaysia.

* cited by examiner

*Primary Examiner* — Robert J Pascal
*Assistant Examiner* — Kimberly E Glenn
(74) *Attorney, Agent, or Firm* — Christopher O. Edwards; Bryan A. Geurts; Mark P. Dvorscak

(57) ABSTRACT

A two-way microwave power divider (the "power divider") may include an input port and two output ports. The power divider may also include a junction that is configured to split a feedline from the input port into a first transmission line and a second transmission line. One or more resistors may be placed along the first transmission line and the second transmission line to provide isolation between the two output ports.

14 Claims, 8 Drawing Sheets

(c)

500

TWO-WAY MICROWAVE POWER DIVIDER

STATEMENT OF FEDERAL RIGHTS

The invention described herein was made by employees of the United States Government and may be manufactured and used by or for the Government for Government purposes without the payment of any royalties thereon or therefore.

FIELD

The present invention generally relates to power dividers, and more particularly, to a two-way power divider to provide low reflected power and high isolation between output ports.

BACKGROUND

A mm-wave power divider is used for splitting power equally between two signal branches. The desired mm-wave power divider should split power equally, and has broadband response and low insertion loss. However, the problem is to obtain ultra-broadband response, low loss and with small physical real estate.

The conventional approach uses a Wilkinson power divider that uses quarter-wave transmission lines to impedance match the output branches to the input, and a discrete resistor placed across the output ports to provide isolation between output ports. Since the physical length of the transmission lines must be a quarter wavelength long, the design only functions over a narrow bandwidth. The bandwidth can be extended using multiple stages of quarter wave transformers, known as stepped impedance match.

However, it may be difficult to implement this design to very large bandwidths. Thus, an alternative approach may be beneficial.

SUMMARY

Certain embodiments of the present invention may provide solutions to the problems and needs in the art that have not yet been fully identified, appreciated, or solved by conventional power dividers. For example, some embodiments of the present invention pertain to a two-way microwave power divider using microstrip transmission lines that provide low reflected power and high isolation between output ports.

In an embodiment, a two-way microwave power divider may include an input port and two output ports. The power divider may also include a junction configured to split a feedline from the input port into a first transmission line and a second transmission line, and one or more resistors situated along the first transmission line and the second transmission line to provide isolation between the two output ports. The one or more resistors are placed at a particular location and assigned a resistance value.

In another embodiment, a two-way power divider may include a signal branch split into two separate signal branches, and a plurality of resistors configured to provide isolation between two output ports at the end of the two signal branches. The two separate signal branches are tapered for impedance matching.

In yet another embodiment, a power divider may include a transmission line split into two tapered transmission lines by a junction, and a plurality of resistors positioned along a length of, and in between, the two tapered transmission lines to provide isolation between the two tapered transmission lines.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments of the present invention generally pertain to a two-way microwave power divider (the "power divider"). The power divider may split power equally between two signal branches, and has a broadband response and low insertion loss. Although conventional power divider operates with limited bandwidth of approximately 10 to 20 percent with low return loss, the bandwidth of the power divider in some embodiments described herein may be 3:1 or more.

The two branches are impedance matched to the input port using Klopfenstein tapered transmission lines on each output branch of the junction. This is done to compensate for the inherent large impedance mismatch between the input port and the two output ports. At the junction, the two output ports are in parallel with each other; therefore, the equivalent input impedance is half the characteristic impedance of the system. This results in reflection coefficient of −1/3, which causes 1/9 of the incident power to be reflected back toward the source.

By adding tapered transmission lines on the output branches, the equivalent impedance of the output branches can be increased to appear as almost equal to the characteristic impedance of the system. Thus, the output lines are matched to the input, and a reflected power of 1% can be easily achieved. Lower reflected powers can be achieved by using longer transmissions lines at the expense of using a longer taper. The longer taper may increase the space requirements of the component, and can also increase resistive losses when using lossy transmission lines.

Resistors are distributed along the transmission lines to provide isolation between the two output branches. The resistors may prevent power that enters one of the output port from coupling to the other output port. When applied voltage waves at the output branches differ in either magnitude or phase, a voltage difference exists across the resistors and causes current to flow in the resistors. Thus, a large amount of the power is dissipated in the resistors rather than exiting through any other ports in the system.

Due to the symmetry of the design, very little power is dissipated during normal operation. When power is incident on the input port, the voltage wave will divide at the junction and travel along the output branches. Since the signals are in phase and of equal magnitude, the voltage on each terminal of the resistor is the same so that no current flows in resistor. While this may produce no loss in the resistor, a small amount of loss is observed, thereby increasing with frequency. This is likely due to the finite size of resistor, which would reduce the accuracy of the lumped-element resistor model used in the design.

Figure 1:
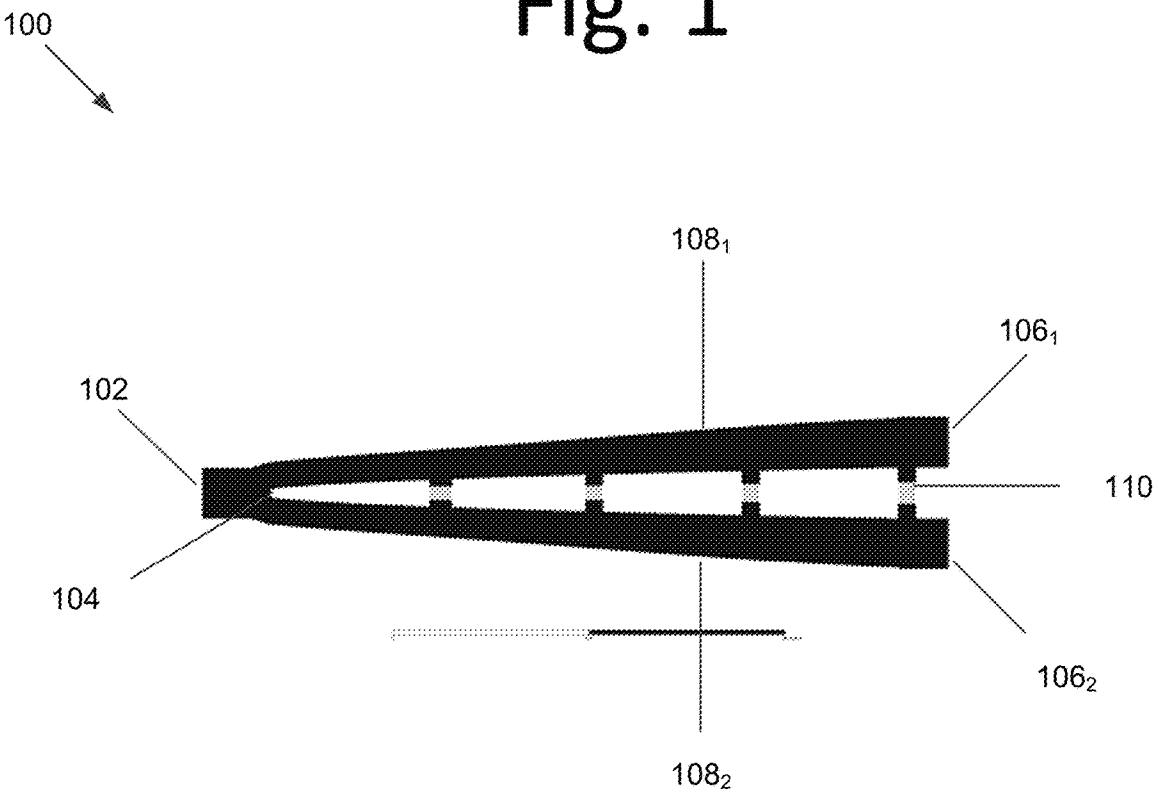
FIG. 1 is a diagram illustrating a power divider, according to an embodiment of the present invention.

FIG. 1 is a diagram illustrating a two-way power divider ("power divider") 100, according to an embodiment of the present invention. Power divider 100 includes an input port 102 and output ports 1061 and 1062. Power divider 100 also includes a junction 104 to split the feedline into transmission lines 1081 and 1082. In some embodiments, microstrip transmission lines 1081 and 1082 are used to provide low reflected power and high isolation between output ports 1061, 1062. In some further embodiments, superconducting transmission lines are used to improve operability of power divider 100 over a larger range of bandwidths. This may be an improvement over conventional power divider where the power dissipation becomes excessive at higher frequencies, effectively limiting the bandwidth of the conventional power device.

Power divider 100 includes a tapered profile to match the impedance of input port 102 and output ports 1061 and 1062 preventing or minimizing the reflection of the wavelength. A plurality of resistors 110 are used in some embodiments to provide isolation between output ports 1061 and 1062. For example, if there was a different signal that was trying to come back to one of output ports 1061, 1062, the signal would not come through the other output port as large.

Resistors 110 are situated at various locations between transmission lines 1081 and 1082. Although FIG. 1 shows four resistors, one of ordinary skill in the art would readily appreciate that power divider 100 may include one or more resistors depending on the isolation desired.

of power divider 100, and tuning the values until an acceptable design was achieved. For example, resistor values were obtained experimentally. First, a large number of resistor profiles are generated by varying the number of resistors, resistance of each resistor, and location of the resistors. Next, the isolation of each resistor profile is analyzed using transmission theory, which resulted in several profiles that satisfies the specifications. Next, a full electromagnetic simulation is performed on the selected profiles using a finite element method solver. After evaluating the performance of each, the best result is selected on the basis of the return loss, insertion loss, and isolation specifications, arriving at the results shown in Table 1.

Figure 2:
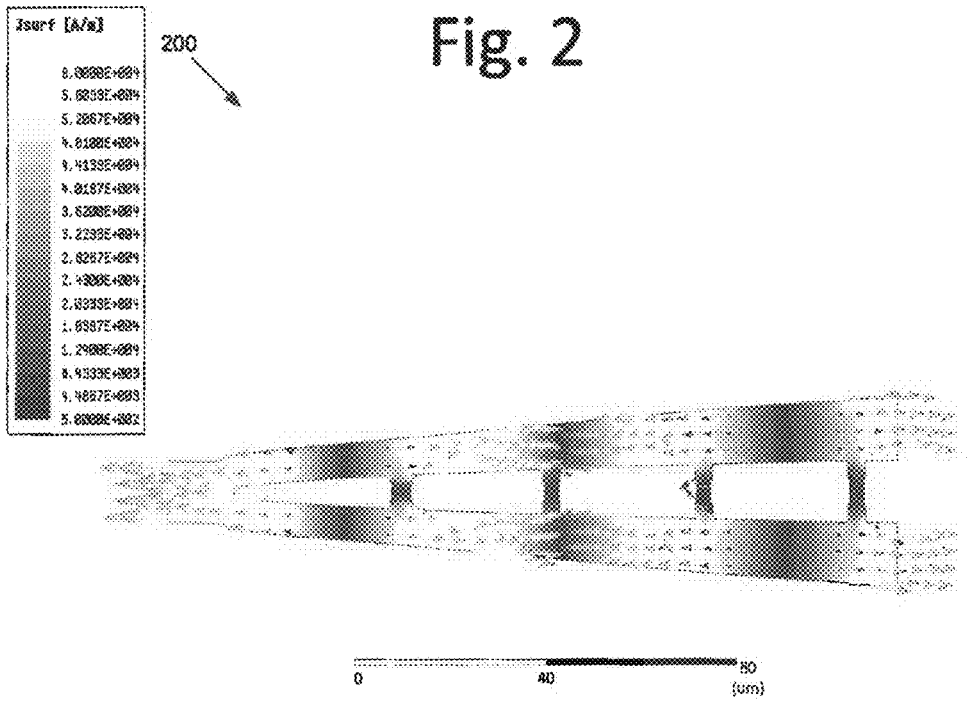
FIG. 2 is a diagram illustrating the even mode current density magnitude of the power divider of FIG. 1, according to an embodiment of the present invention.

FIG. 2 is a diagram illustrating the even mode current density vector of power divider 100 of FIG. 1, according to an embodiment of the present invention. In this simulation, the two output ports are excited with in phase, equal amplitude voltage waves. Due to the symmetry of the structure, the voltage in each branch are equivalent, and resulting in very little current flowing in the resistors, minimizing power loss during normal operation as a power divider or combiner.

Figure 3:
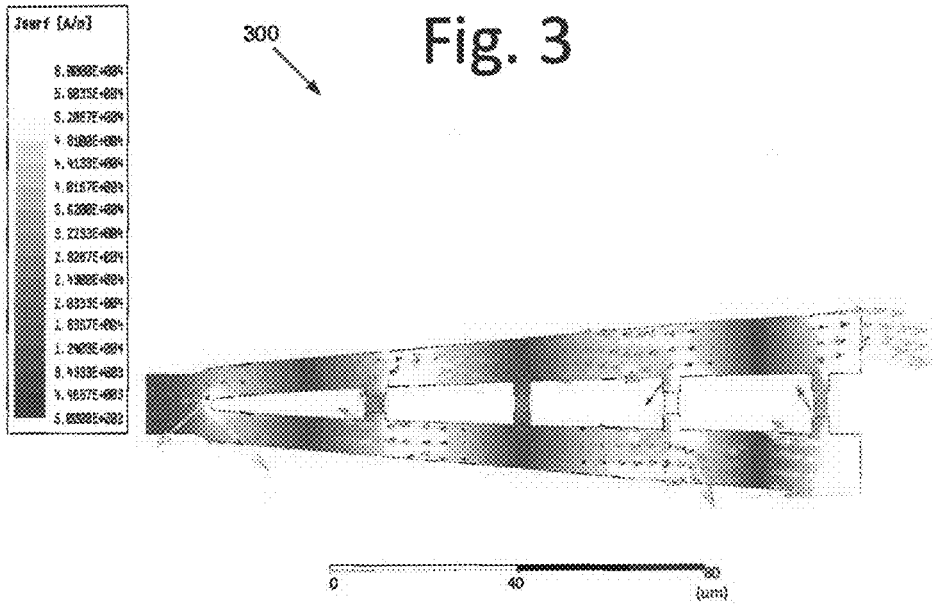
FIG. 3 is a diagram illustrating odd mode current density vector of the power divider of FIG. 1, according to an embodiment of the present invention.

FIG. 3 is a diagram illustrating odd mode current density vector of power divider 100 of FIG. 1, according to an embodiment of the present invention. In this simulation, the two output power are excited with 180° out of phase, equal amplitude voltage waves. In this example, the voltages on each branch are opposite, resulting in a significant current flow, and thus power dissipation through the resistors. Simply put, this figure illustrates the output port isolation properties of the power divider.

The power divider may possess many advantages over the conventional dividers. For example, the power divider excels at very large bandwidths because a tampered impedance match has no upper frequency limitation on the impedance match. This is similar to a high pass filter and unlike the stepped impedance approach, which exhibits a lower and upper cut off frequency. Further, the tapered transmission lines eliminate many of the discontinuities in the layout. This may reduce microwave junction effects and is often easier to accurately fabricate using existing technologies.

TABLE 1

| Resistor Designation | Resistance (Ω) | Normalized Resistance (R/Z) | Location (μm) | Normalized Location (λ) | Length (μm) | Width (μm) | Aspect Ratio |
|---|---|---|---|---|---|---|---|
| R1 | 30 | 6 | 133.64 | 0.51 | 4.5 | 3 | 1.5 |
| R2 | 25 | 5 | 101.45 | 0.39 | 3.75 | 3 | 1.25 |
| R3 | 20 | 4 | 69.25 | 0.27 | 3 | 3 | 1 |
| R4 | 15 | 3 | 37.05 | 0.14 | 3 | 4 | 0.75 |

From Table 1, it should be noted that location specifies the horizontal distance between the power divider junction 104 and resistors. The normalized location is the resistor location divided by the wavelength at the lowest frequency within the bandwidth. For our design, the lowest frequency was 300 GHz and the resulting wavelength was approximately 257 microns. For the designations, R1 corresponds to resistor on the far right side of FIG. 1, followed by R2 on left, and so on. The normalized resistance is the resistance relative to the characteristics impedance of the system, which was 5 ohms for our design. Length is the vertical extent of each resistor, and width is the horizontal extent of each resistor, for example.

Figure 4:
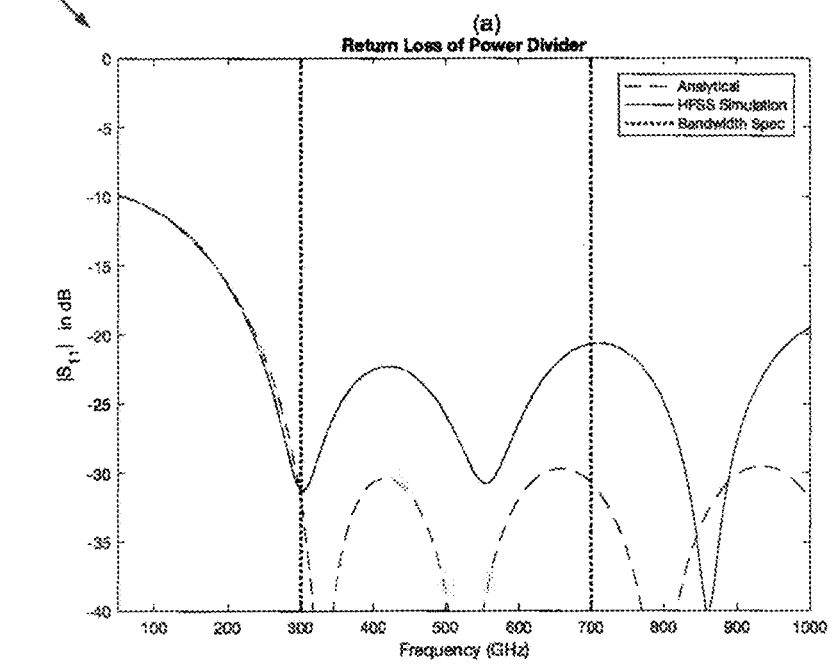
FIGS. 4 and 5 illustrate plots showing the performance of the power divider 100 of FIG. 1, according to an embodiment of the present invention.
Figure 4:
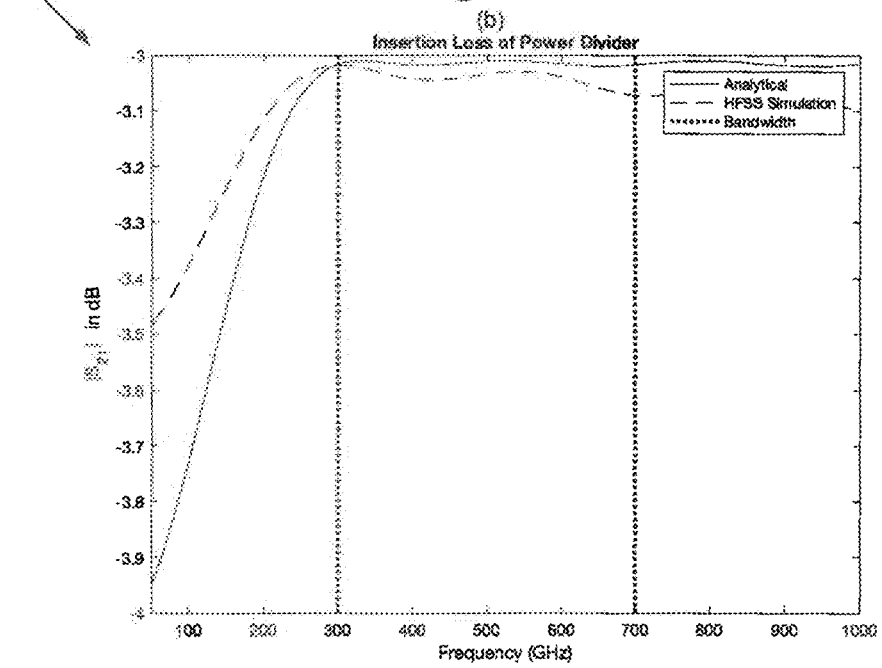
Figure 4:
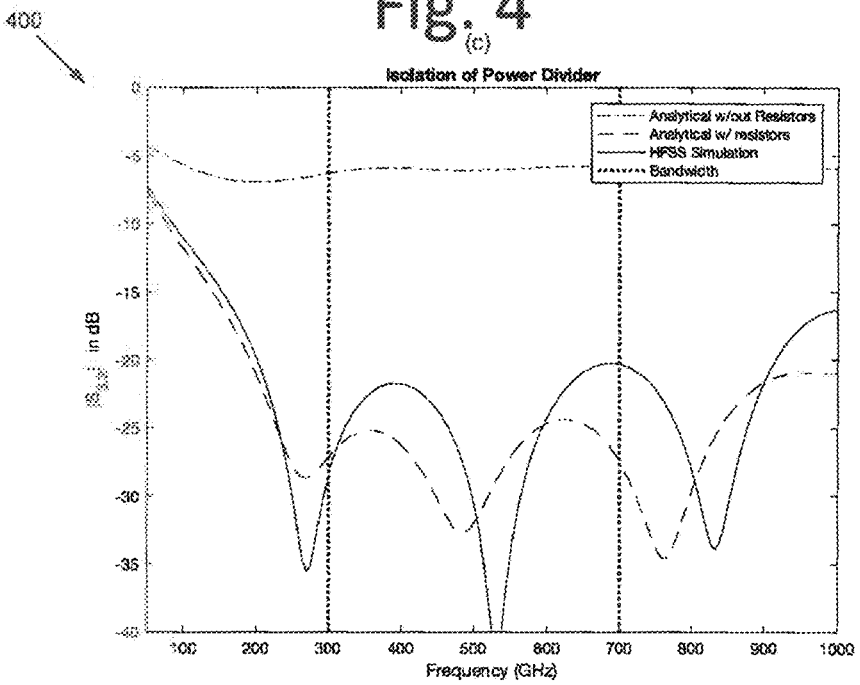
Figure 4:
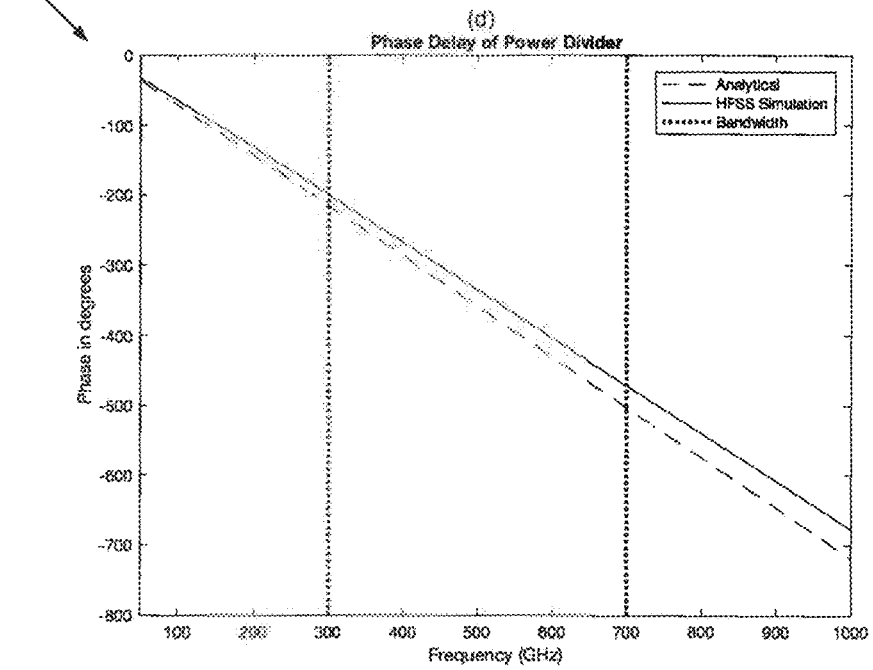
Figure 5:
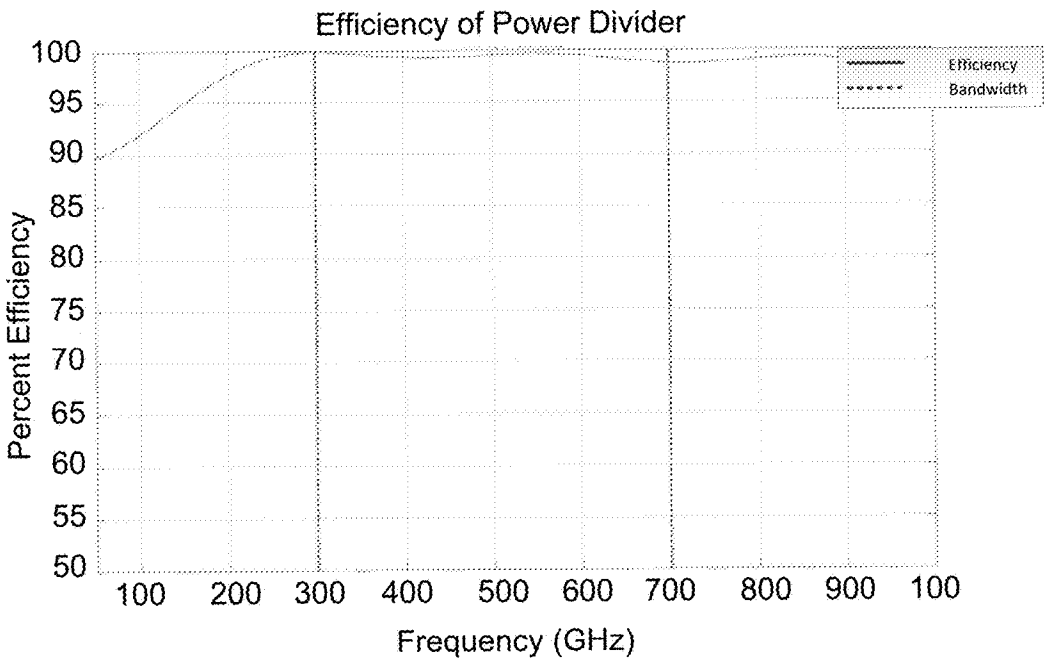

It should be appreciated that these values were obtained by running multiple numerical electromagnetic simulations FIGS. 4 and 5 illustrate plots 400 and 500 showing the performance of the power divider 100 of FIG. 1, according to an embodiment of the present invention. Plot 4(*a*) shows the return loss versus frequency of the power divider. This represents the amplitude of the wave reflected back toward the source relative to incident wave on the input port, expressed in decibels. Plot 4(*a*) shows a significant amount of power being reflected toward the source for lower frequencies. This power decreases until a cutoff frequency where the amplitude of the wave becomes small (e.g., below −20 dB) after reaching the cutoff frequency near the beginning of the bandwidth. This is expected due to the high-pass nature of the taper used for the impedance match. Plot 4(*b*) shows the insertion loss of the device, which represents amplitude of the wave reaching one of the output ports relative to amplitude of a wave incident on the input port. As expected, the insertion loss of the power divider appears to be very close to −3 dB within the bandwidth, corresponding to nearly half power being coupled to that output port. Plot 4(*c*) shows the isolation of the power divider. The isolation may represent the amplitude of the wave reaching one of the output ports relative to the amplitude of a wave incident from the other output port. The power divider provides an isolation below −20 dB, meaning less than 1% power coupling between output ports. Plot 4(*d*) shows the phase delay of the power divider versus frequencies, which represents the amount of electrical delay between the output and input ports. In FIG. 5, plot 500 shows the power efficiency of the device. The power of efficiency is defined as the ratio of the total output power of both output ports relative to the input power. The efficiency is near 99% over the bandwidth. The two sources of loss that reduce the efficiency include power being reflected back toward the source and power being dissipated in the isolation resistors. Each of the plots discussed above contains two traces—the "analytical" trace and the "HFSS Simulation" trace. The analytical trace refers to the value performance of the device computed using transmission line analysis, and the "HFSS Simulation" trace refers to the electromagnetic simulation performed using Ansys HFSS software.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A two-way microwave power divider, comprising:

an input port and two output ports;

a junction configured to split a feedline from the input port into a first transmission line and a second transmission line; and one or more resistors situated along the first transmission line and the second transmission line to provide isolation between the two output ports, wherein the one or more resistors are placed at a particular location and assigned a resistance value; further wherein the first transmission line and the second transmission line are tapered for impedance matching and are superconducting transmission lines to improve coverage of the power divider over a wider range of bandwidths.

2. The two-way microwave power divider of claim 1, wherein the particular location for the one or more resistors specifies a horizontal distance between the junction and the one or more resistors.

3. The two-way microwave power divider of claim 1, wherein the one or more resistors comprise a length and a width, the length being a vertical extent of the one or more resistors, and width being the horizontal extent of the one or more resistors.

4. The two-way microwave power divider of claim 1, wherein a normalized resistance of the one or more resistors is relative to characteristics impedance of the power divider.

5. The two-way microwave power divider of claim 1, wherein a normalized location of the one or more resistors is the particular location of the one or more resistors divided by a wavelength at lowest frequency within a bandwidth.

6. A two-way power divider, comprising:

a signal branch split into two separate signal branches;

a plurality of resistors configured to provide isolation between two output ports at the end of the two signal branches, wherein the two separate signal branches are tapered for impedance matching; and a junction near an input port for splitting the signal branch into the two separated signal branches; and further wherein when power is incident on the input port, the junction is configured to divide the voltage wave such that the divided voltage wave travels along the two separate signal branches.

7. The two-way power divider of claim 6, wherein the divided voltage wave are in phase and of equal magnitude such that a voltage on each terminal for each of the plurality of resistors is same preventing current from flowing into each of the plurality of resistors.

8. The two-way power divider of claim 7, wherein each of the plurality of resistors are distributed at a particular location along the two separate signal branches configured to provide isolation between the two separated signal branches.

9. The two-way power divider of claim 8, wherein the plurality of resistors being used depends on a desired isolation.

10. The two-way power divider of claim 8, wherein the particular location for each of the plurality of resistors specifies a horizontal distance between the junction and each of the plurality of resistors.

11. The two-way power divider of claim 8, wherein each of the plurality of resistors comprise a length and a width, the length being a vertical extent for each of the plurality of resistors, and width being the horizontal extent for each of the plurality of resistors.

12. The two-way power divider of claim 8, wherein a normalized resistance for each of the plurality of resistors is relative to characteristics impedance of the two-way power divider.

13. The two-way power divider of claim 12, wherein the normalized location for each of the plurality of resistors is the particular location for each of the plurality of resistors divided by a wavelength at lowest frequency within a bandwidth.

14. A power divider, comprising:

a transmission line split into two tapered transmission lines by a junction; and a plurality of resistors positioned along a length of, and in between, the two tapered transmission lines to provide isolation between the two tapered transmission lines; wherein each of the plurality of resistors comprise a length and a width, the length being a vertical extent for each of the plurality of resistors, and width being the horizontal extent for each of the plurality of resistors and further wherein each of the plurality of resistors are positioned at a particular location, specifying a horizontal distance between the junction and each of the plurality of resistors.

* * * * *